United States Patent [19]

Settles et al.

[11] 3,967,552

[45] July 6, 1976

[54] PERCUSSION IGNITION SYSTEM FOR A SMOKELESS, FLASHLESS, LOW NOISE CARTRIDGE

[75] Inventors: Charles P. Settles, Forest Hill, Md.; Edward R. Evans, Sicklerville, N.J.

[73] Assignee: The United States of America as represented by the Secretary of the Army, Washington, D.C.

[22] Filed: Dec. 17, 1974

[21] Appl. No.: 533,438

[52] U.S. Cl. ..... 102/38; 102/40

[51] Int. Cl.[2] ..... F42B 5/10

[58] Field of Search ..... 102/38, 40, 45; 89/1 B

[56] References Cited

UNITED STATES PATENTS

| | | | |
|---|---|---|---|
| 3,106,131 | 10/1963 | Barr et al. | 89/1 B |
| 3,119,302 | 1/1964 | Barr | 89/1 B |
| 3,176,615 | 4/1965 | De Matthew | 102/38 |
| 3,404,598 | 10/1968 | Angelos | 102/38 |
| 3,738,271 | 6/1973 | La Costa | 102/38 |
| 3,776,136 | 12/1973 | Dix et al. | 102/38 |

*Primary Examiner*—Verlin R. Pendegrass
*Attorney, Agent, or Firm*—Nathan Edelberg; A. Victor Erkkila; Max Yarmovsky

[57] ABSTRACT

A sealed combustion cartridge mechanism is used to propel a projectile and to ignite an impact percussion type primer which in turn activates a delay train located in the projectile. The forward end of a cup seal telescoping propelling member is axially dimpled so that it will hold the primer in close proximity to the delay train. The convex portion of the dimple protrudes toward a movable propellant cup slidably contained within the closed combustion telescoping member. The propellant cup upon ignition of the propellant is forcibly thrown, by the rapidly expanding gases, against the protruding dimple and the rear of the projectile. The kinetic energy of impact of the propellant cup against the dimpled surface of the telescoping member is utilized not only to help the expanding telescoped cup seal member drive the projectile from the cartridge, but also to ignite the primer and start the delay train of the propelled round.

5 Claims, 5 Drawing Figures

14
34
30
36
38

10
40
12
32
16
58
18
20
26
28
24
22
44
42
41

52
41

22
44
48
50

30
41

10
40
60

30

10
40

PERCUSSION IGNITION SYSTEM FOR A SMOKELESS, FLASHLESS, LOW NOISE CARTRIDGE

GOVERNMENTAL INTEREST

The invention described herein may be manufactured, used and licensed by or for the Government for governmental purposes without the payment to us of any royalty thereon.

BACKGROUND OF THE INVENTION

Various means have been used in the prior art to provide troops with a closed combustion cartridge which, upon expulsion of a round therefrom, would not reveal the firing location of the gunner. The importance of a smokeless, flashless, low noise weapon system is of particular importance whenever it is desired to use a hand held, shoulder fired grenade launching weapon against out of line-of-sight targets. Munitions fired from closed combustion cartridges which may be armed by set back and spin forces and exploded upon impact with a target have been disclosed in the prior art in U.S. Pat. No. 3,738,271 of Nicholas J. LaCosta. However, prior art sealed cup cartridges of the smokeless, flashless type have failed to solve the problem of expelling a signal projectile which must have its delay trains initiated while in the launching weapon. Short delays are necessary whenever it is desired to have a signal projectile operate only several hundreds of feet away from the launch site. Prior art closed combustion cartridges merely solved the problem of propelling the round from the cartridge without evidence of smoke, flash and low noise, but did not provide the necessary combination of elements in their structure to assure quick ignition of the delay train of a projectile or a signal device which had to operate at a burst height range of 500 to 700 feet above ground.

SUMMARY OF THE INVENTION

The present invention relates to a closed combustion cartridge having a percussion ignition system for igniting a round having a short delay train therein. A telescoping cup sealed member contains a dimple therein which holds the percussion primer adjacent to the flash hole of a delay train. A slidably positioned propellant cup contained within a sealed telescoping propulsion member is used to impart its kinetic energy to the dimpled protrusion thereby activating the impact sensitive primer and aiding the unfolding telescoping member in propelling the round out of its cartridge.

An object of the present invention is to provide a percussion ignition system for a closed combustion cartridge.

Another object of the present invention is to provide a closed combustion cartridge having the capability of igniting the delay elements of a standard signal projectile.

A further object of the present invention is to provide a percussion ignition system having the capability of activating the delay train of a signal projectile propelled by a closed combustion cartridge.

For a better understanding of the present invention, together with other and further objects thereof, reference is made to the following descriptions taken in connection with the accompanying drawings.

BRIEF DESCRIPTION OF THE DRAWINGS

Throughout the following description like reference numerals are used to denote like parts of the drawings.

DESCRIPTION OF THE PREFERRED EMBODIMENTS

Figure 1:
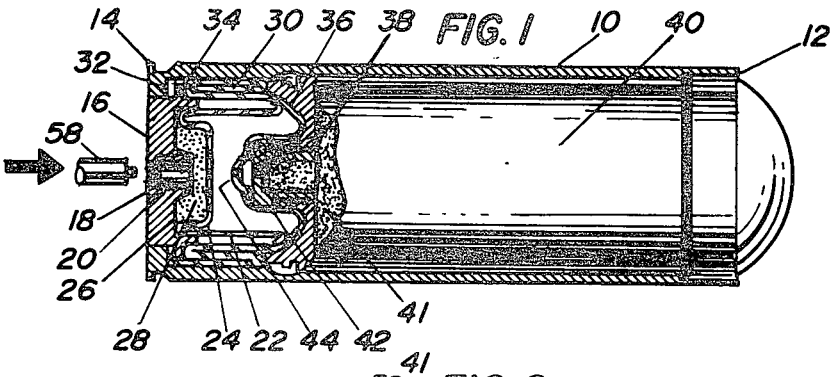
FIG. 1 is a partial longitudinal diametral cross-sectional view of the cartridge before firing.

Referring now to FIGS. 1–5 a cylindrically shaped cartridge case 10 has a forward open end 12 and a rear end 14 which has a cup shaped base 16 fixedly positioned therein. Base 16 has an axial bore 18 which fixedly holds a cartridge impact primer 20. A propellant cup 22 has an inverted closed end 24 slidably positioned in annular base cavity 26, and an open end 27. A propellant charge 28 fills the space intermediate cavity 26 and closed end 24. A telescoping combustion cup seal member 30 has a first open end 32 which is fixedly held intermediate cartridge case closed end 14 and base shoulder 34 of base 16. A second cup seal front end 36 conforms to the rear end 38 of round 40. An axial re-entrant cup seal wall section 42 contains an axially rearwardly protruding dimpled wall section 44 thereon. A delay insert 46 is threadedly fixed to round rear end 38 and has an axial flash hole 48 which communicates with an axially aligned delay counterbore 50 which in turn contains a delay train 52 therein. Intermediate the dimpled wall section 44 and the delay insert 46 is an annular disc shaped styrofoam spacer 54 which contains an axially positioned round primer 56 therein.

Figure 2:
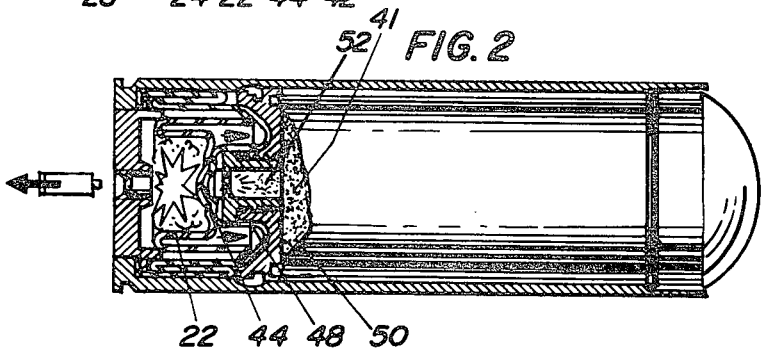
FIG. 2 is a partial longitudinal diametral cross-sectional view of the cartridge a short time after firing at the time the projectile primer is ignited.
Figure 3:
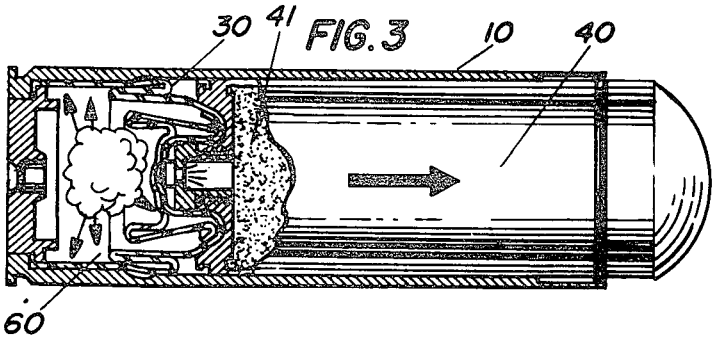
FIG. 3 is a partial longitudinal diametral cross-sectional view of the cartridge after firing at a time that the ignited projectile has begun to move out of the cartridge case.
Figure 4:
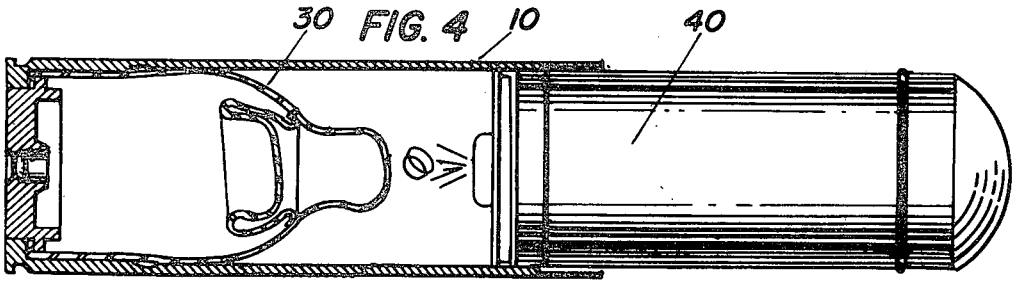
FIG. 4 is a partial longitudinal diametral cross-sectional view of the fired cartridge whose projectile delay train has been ignited and where the sealed closed combustion chamber has been extended to its full length.
Figure 5:
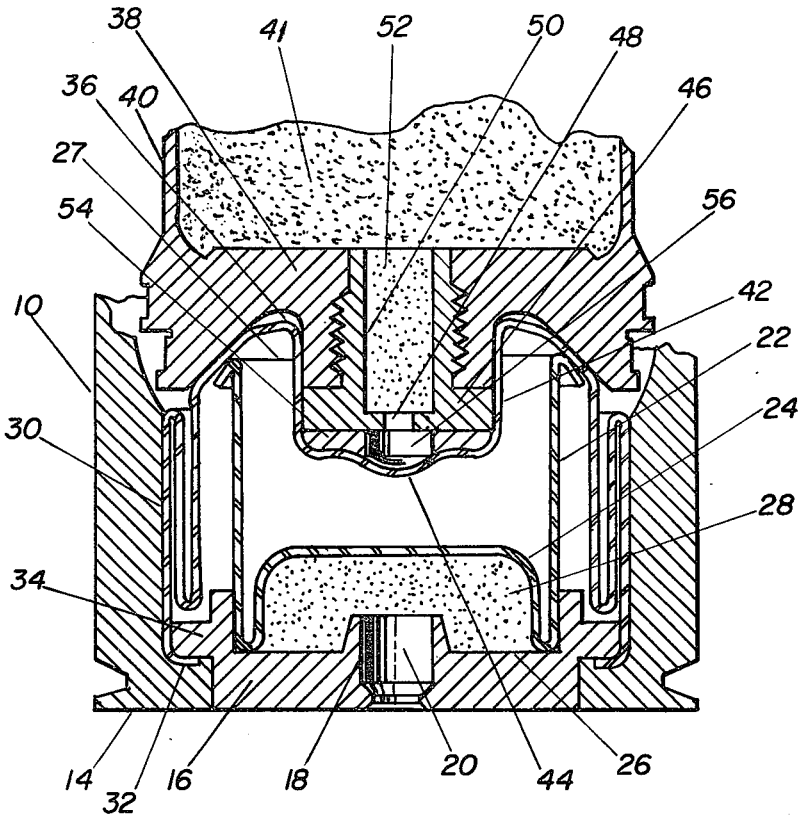
FIG. 5 is an enlarged cutaway partial cross-sectional view of FIG. 1 showing the interface section of the round with the closed combustion chamber of the cartridge.

In operation a firing pin 58, as shown in FIG. 1, strikes the cartridge impact primer 20 which in turn ignites propellant charge 28. Upon ignition of propellant charge 28 the propellant cup 22 as shown in FIG. 2 unrolls and impacts the bottom of the dimpled wall section 44. The impact imparted by wall section 44 on the round primer 56 causes the primer mix contained therein, not shown, to fire through flash hole 48, thus igniting the delay train 52. The delay train 52 is for the purpose of igniting a signal charge contained in round cavity 41, after passage of a predetermined time interval subsequent to firing of round primer 56, which time interval is determined by the burning rate of delay train 52. Continued expansion of the propellant gases 60 causes the cup seal member 30 to unfold, as shown in FIG. 3, forcibly pushing round 40 out of cartridge case 10. FIG. 4 shows cup seal member 30 in its fully extended position and the ignited round 40 exiting from cartridge case 10.

The foregoing disclosure and drawings are merely illustrative of the principles of this invention and are not to be interpreted in a limiting sense. We wish it to be understood that we do not desire to be limited to the exact details of construction shown and described for obvious modifications will occur to a person skilled in the art.

Having thus fully described the invention, what is claimed as new and desired to be secured by Letters Patent of the United States is:

1. A percussion ignition system for a closed combustion cartridge which comprises:

a cartridge case having a forward open end and a rear end;

a base fixedly positioned in the rear end of said case, said base having an axial bore therein and an annular cavity which communicates with said axial bore;

a cartridge impact primer fixedly positioned in said axial bore;

a round slidably positioned in said case;

delay means, axially positioned in the rear end of said round, for actuating said round after said round is expelled from said case;

sealed telescoping means, positioned in said case intermediate said base and the rear end of said round, for propelling said round out of said case toward a target without evidence of smoke or flash;

ignition means, positioned intermediate said telescoping means and said delay means, for initiating said delay means when said round is being propelled from said case; and propelling means, slidably positioned in the annular cavity of said base, for generating gases which rapidly expand said telescoping means and for impacting against said telescoping means to activate said ignition means.

2. A device as recited in claim 1 wherein said delay means comprises:

a delay insert axially positioned and threadedly fixed to the rear end of said round, said insert having an axial delay counterbore therein and an axially positioned flash hole which communicates with said delay counterbore; and a delay charge positioned in said delay counterbore;

3. A device as recited in claim 1 wherein said telescoping means comprises:

a combustion cup seal member having a first open end which is fixedly held intermediate said cartridge case and said base, a second cup seal front end which conforms to the rear end of said round, and an axial re-entrant cup seal wall section having an axially protruding dimpled wall section thereon.

4. A device as recited in claim 1 wherein said ignition means comprises:

an annular spacer positioned intermediate said delay insert and said re-entrant cup seal wall section; and an impact sensitive round primer fixedly positioned against said dimpled wall section in said annular spacer.

5. A device as recited in claim 1 wherein said propelling means comprises:

a propellant cup having an inverted closed end slidably positioned in the annular cavity of said base and an open end; and a propellant charge positioned intermediate the annular cavity of said base and said inverted closed end.

* * * * *